US008087913B2

(12) United States Patent
Heitz

(10) Patent No.: US 8,087,913 B2
(45) Date of Patent: Jan. 3, 2012

(54) GEAR PUMP WITH UNEQUAL GEAR TEETH ON DRIVE AND DRIVEN GEAR

(75) Inventor: Steven A. Heitz, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 434 days.

(21) Appl. No.: 12/341,030

(22) Filed: Dec. 22, 2008

(65) Prior Publication Data

US 2010/0158738 A1 Jun. 24, 2010

(51) Int. Cl.
*F03C 4/00* (2006.01)
*F04C 18/00* (2006.01)
*F04C 2/00* (2006.01)

(52) U.S. Cl. ..... 418/206.5; 418/189; 418/190

(58) Field of Classification Search ..... 418/189, 418/190, 206.1, 206.5; 74/409, 460, 461
See application file for complete search history.

(56) References Cited

U.S. PATENT DOCUMENTS 295,597 A * 3/1884 Troutman ..... 418/206.5
2,354,992 A * 8/1944 Gottlieb ..... 418/189
3,120,190 A * 2/1964 Schmitter et al. ..... 418/191
4,386,893 A * 6/1983 Hauser, Jr. ..... 418/191
4,729,727 A 3/1988 Aarestad
5,108,275 A 4/1992 Sager
5,114,325 A 5/1992 Morita
6,123,533 A * 9/2000 McBurnett et al. ..... 418/191
6,149,415 A 11/2000 Thompson
6,460,935 B1 * 10/2002 Rees et al. ..... 297/478
6,893,240 B2 5/2005 Bush
6,988,877 B2 1/2006 Bush
7,040,870 B2 5/2006 Nicolas
7,094,042 B1 8/2006 Borgetti
7,153,111 B2 12/2006 Bush
7,335,005 B2 2/2008 Cottais

FOREIGN PATENT DOCUMENTS

JP 60150492 A * 8/1985 ..... 418/206.5

* cited by examiner

*Primary Examiner* — Theresa Trieu
(74) *Attorney, Agent, or Firm* — Carlson, Gaskey & Olds, PC

(57) ABSTRACT

A gear pump comprises a first gear to be connected to a source of drive, and having a first plurality of gear teeth. A second gear has a second plurality of teeth engaged with the first gear teeth. The first gear teeth contact the second gear's teeth on a contact face, causing the second gear to rotate. The first plurality of teeth is greater than the second plurality of teeth.

7 Claims, 1 Drawing Sheet

GEAR PUMP WITH UNEQUAL GEAR TEETH ON DRIVE AND DRIVEN GEAR

BACKGROUND OF THE INVENTION

This application relates to a gear pump wherein the driven gear has fewer teeth than does the drive gear.

Gear pumps are known, and typically include a pair of gears mounted for rotation about parallel axes. One of the gears is driven to rotate by a drive, such as a motor. Gear teeth on this drive gear engage gear teeth on a driven gear, and cause the driven gear to rotate with the drive gear. Pump chambers are formed by the spaces between the teeth, and move fluid from an inlet to an outlet around an outer periphery of both gears.

There are challenges when gear pumps are utilized to pump several fluids, and in particular when used to pump fuel. When utilized as a fuel pump, operating pressure and temperature have reached levels that challenge the materials currently utilized for the gear.

Typically, a high tooth count is seen as desirable to reduce contact sliding velocities and gear wear. A high tooth count is also desirable to reduce the pressure ripple in the supply and discharge lines.

SUMMARY OF THE INVENTION

A gear pump comprises a first gear to be connected to a source of drive, and having a first plurality of drive gear teeth. A second gear has a second plurality of teeth engaged with the drive gear teeth. The drive gear teeth contact the second gear's teeth on a contact face, causing the second gear to rotate. The first plurality of teeth is greater than the second plurality of teeth.

These and other features of the present invention can be best understood from the following specification and drawings, the following of which is a brief description.

DETAILED DESCRIPTION OF THE PREFERRED EMBODIMENT

Figure 1:
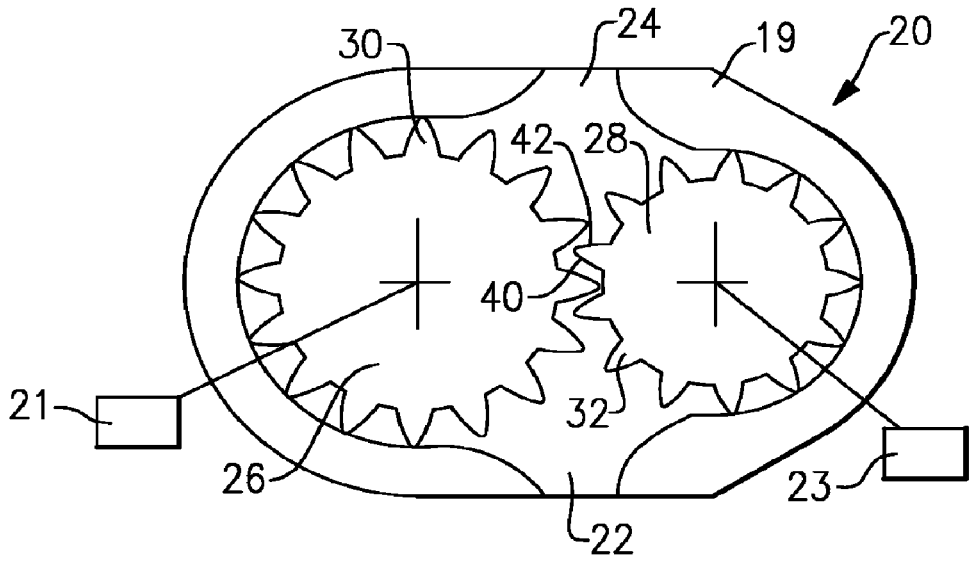
FIG. 1 schematically shows an inventive gear pump.

FIG. 1 shows a gear pump 20 incorporating a housing 19 mounting a drive gear 26 and a driven gear 28. As known, teeth 30 on drive gear 26 contact a contact face 42 of teeth 32 on the driven gear, and cause the driven gear 28 to rotate. The drive gear 26 will rotate clockwise as shown in FIG. 1, while the driven gear rotates counter-clockwise. Spaces between the teeth move fluid from an inlet 22 to an outlet 24 as this rotation occurs. A drive means 21 of some sort drives the drive gear 26. Optionally, a component of some sort such as a generator or centrifugal pump 23 may be attached to the driven gear 28 to generate electricity or pump fluid. The power to drive the component must pass through the gear mesh of the pumping gears resulting in higher gear tooth contact stresses.

As shown in FIG. 1, the drive gear has a first number of teeth (e.g. 16 as illustrated), while the driven gear 28 has a second lower number of teeth (shown as 13). Of course, other numbers of teeth may be utilized.

The greater number of teeth on the drive gear will ensure that the reduction of teeth numbers on the driven gear will not reduce the flow rate of the pump, and will not create any significant increase in flow pulsation.

As can be appreciated from FIG. 1, the driven gear 28 is made to have a smaller diameter than the drive gear 26. This allows a reduction of pump size and weight.

The proposed invention increases the tooth contact stress due to a component such as a high speed generator or pump mounted at the high speed driven gear. Centrifugal pumps and generators both exhibit increased efficiency and reduced weight when operated at higher speed. Additional weight saving result from packaging additional components within the pump as opposed to mounting them with a separate drive and mounting.

Additional wear resistance is achieved by increasing the radius of curvature of the gear teeth. This is typically achieved by specifying a 30° operating pressure angle as apposed to 20° to 25° pressure angles used for power transmission gearing. The tooth apex width and the profile contact ratio are both reduced as the operating pressure angle is increased. A minimum gear tooth apex thickness is desirable to increase pumping efficiency and to reduce handling damage associated with a pointed apex. The proposed invention overcomes these limitations by utilizing an asymmetric gear tooth. For example, the contact face pressure angle is increased from 30° to 35°. This widens the gear tooth while also increasing the radius of curvature of the contact side of the tooth. The non-contact tooth face must be thinned in order to maintain the tooth space required to accept the driven gear tooth. This is accomplished by a corresponding reduction in the pressure angle of the non-contact gear face from 30° to 25°

Figure 2:
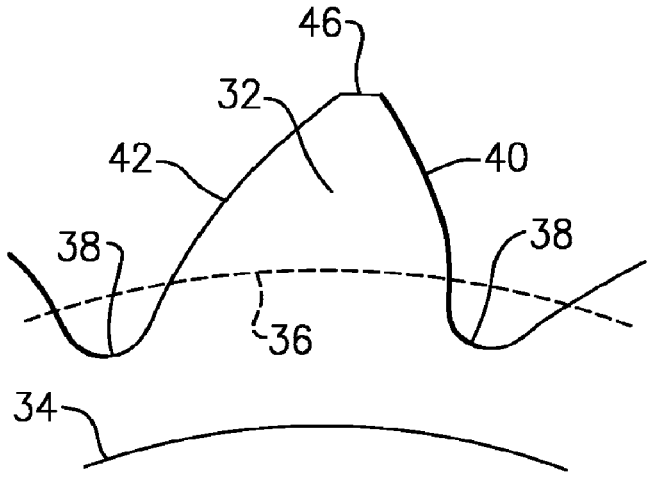
FIG. 2 shows a tooth profile on a driven gear for the inventive gear pump.

As shown in FIG. 2, a special profile for the gear teeth 30 and 32 may include a first involute having a relatively greater radius of curvature used to define the contact face 42. The base circle used to generate the radius of curvature for the contact face 42 is shown as circle 34. The non-contact face 40 is formed by an involute having a radius of curvature generated from base circle 36. By having the greater radius of curvature 42 on the contact face, the gear tooth 32 has an increased resistance to tooth wear or damage.

An apex 46 of the gear tooth is shown to be flat. Spaces or gaps 38 between the gear teeth 32 are shown to extend radially inwardly inward of the circle 36 associated with the radius of curvature of the non-contact face 40, but still radially outwardly of the circle 34 associated with the radius of curvature of the contact face 42.

Stated another way, the driven gear teeth have asymmetric faces relative to a centerline defined by a radius extending radially outwardly from an axis of a gear tooth.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A gear pump comprising:

a first gear to be connected to a source of drive, said first gear having a first plurality of teeth;

a second gear having a second plurality of teeth, said teeth on said first gear contacting said teeth on a second gear on a contact face, and causing said second gear to rotate;

said first plurality of teeth being greater than said second plurality of teeth;

a component associated with said second gear to create power as said second gear is driven; and said teeth on said gears each having asymmetric faces relative to a centerline defined by a radius extending radially outwardly from a center of said second gear to an apex of each said tooth on said second gear.

2. The gear pump as set forth in claim 1, wherein said second gear has a smaller outer diameter than an outer diameter of said first gear.

3. The gear pump as set forth in claim 1, wherein said teeth on said second gears have said contact face and a non-contact face, and said contact face being designed to provide an effectively thicker gear tooth apex.

4. A gear pump comprising:

a first gear to be connected to a source of drive, said first gear having a first plurality of teeth;

a second gear having a second plurality of teeth, said teeth on said first gear contacting said teeth on a second gear on a contact face, and causing said second gear to rotate;

said first plurality of teeth being greater than said second plurality of teeth;

said teeth on said gears each having asymmetric faces relative to a centerline defined by a radius extending radially outwardly from a center of said second gear to an apex of each said tooth on said second gear; and said contact face and a non-contact face each being defined by an involute, with said involute defining said contact face having a greater radius of curvature than said involute defining said non-contact face.

5. The gear pump as set forth in claim 4, wherein gaps are defined circumferentially between adjacent ones of said second plurality of gear teeth, said gaps extending radially inwardly beyond a circle which defines the radius of curvature for said involute defining said non-contact face.

6. The gear pump as set forth in claim 5, wherein a circle defining the radius of curvature of said contact face being radial inward of a radially innermost portion of said gaps.

7. A gear pump comprising:

a first gear to be connected to a source of drive, said first gear having a first plurality of teeth;

a second gear having a second plurality of teeth, said teeth on said first gear contacting said teeth on a second gear on a contact face, and causing said second gear to rotate;

said first plurality of teeth being greater than said second plurality of teeth;

said second gear has a smaller outer diameter than an outer diameter of said first gear;

said teeth having asymmetric faces relative to a centerline defined by a radius extending radially outwardly from a center of said second gear to an apex of each said tooth on said second gear;

said teeth on said second gear have said contact face and a non-contact face, and said contact face being designed to provide an effectively thicker gear tooth apex, said contact face and said non-contact face are each defined by an involute, with said involute defining said contact face having a greater radius of curvature than said involute defining said non-contact face; and gaps are defined circumferentially between adjacent ones of said second plurality of gear teeth, said gaps extending radially inwardly beyond a circle which defines the radius of curvature for said involute defining said non-contact face, a circle defining the radius of curvature of said contact face being radial inward of a radially innermost portion of said gaps.

* * * * *